US007677283B2

(12) United States Patent
Hooker

(10) Patent No.: US 7,677,283 B2
(45) Date of Patent: Mar. 16, 2010

(54) WORKBENCH ACCESSORY

(76) Inventor: Michael Hooker, P.O. Box 566, McArthur, CA (US) 96056

( * ) Notice: Subject to any disclaimer, the term of this patent is extended or adjusted under 35 U.S.C. 154(b) by 327 days.

(21) Appl. No.: 11/827,312

(22) Filed: Jul. 11, 2007

(65) Prior Publication Data

US 2008/0017275 A1 Jan. 24, 2008

Related U.S. Application Data

(60) Provisional application No. 60/830,060, filed on Jul. 11, 2006.

(51) Int. Cl.
*B25H 1/00* (2006.01)

(52) U.S. Cl. ..... 144/286.5; 83/469

(58) Field of Classification Search ..... 144/286.1, 144/286.5, 287, 134.1; 83/469, 471.2, 477, 83/477.2

See application file for complete search history.

(56) References Cited

U.S. PATENT DOCUMENTS 5,884,681 A * 3/1999 Nickles ..... 144/329
6,488,256 B1 * 12/2002 Chang ..... 248/670
6,619,348 B2 * 9/2003 Wang ..... 144/287
6,688,350 B2 * 2/2004 Heinlen et al. ..... 144/285

* cited by examiner

*Primary Examiner*—Shelley Self
(74) *Attorney, Agent, or Firm*—James Ray & Assoc

(57) ABSTRACT

An apparatus that offers a simple method for using tools on a workbench without permanently mounting or positioning all of them at one time. The apparatus consists of a two individual interlocking components. There is a rectangular shaped metal base plate milled on the top, which allows for easy mounting of most bench tools to the base plate. A tool mounting plate is attached, one per tool, to the bottom of the tool in a predetermined manner enabling the user to change tools when needed without losing time changing the mounting plate. The tool mounting plate is designed with overhanging side edges that interlock with the base plate onto which it slides. The base plate is designed so that the protruding outer edges permit the tool mount to slide onto and into the base plate for secure positioning of the two plates together. The base plate is bolted to the worktable. A cam lock arrangement is used to hold the mounting plates securely in place until ready for removal.

10 Claims, 4 Drawing Sheets

WORKBENCH ACCESSORY

CROSS REFERENCE TO RELATED APPLICATIONS

This application is closely related to and claims benefit from U.S. Provisional Application Ser. No. 60/830,060 filed Jul. 11, 2006.

FIELD OF THE INVENTION

The present invention relates, in general, to an apparatus for use with a workbench, and, more particularly, the present invention relates to a bench saver in which such bench saver offers a worker or hobbyist the ability to interchange tools that will fit on a plate that is bolted directly to a workbench.

BACKGROUND OF THE INVENTION

People that work with bench tools often find that the work bench gets so cluttered with tools that there is very little room on the bench to perform other tasks on the bench. This happens when, for example, a bench vice, grinder, drill press and other needed tools are mounted on a workbench. Mounting these items often leaves multiple holes in the bench that can interfere with other work.

Thus, it would be advantageous if there were an apparatus or a means for enabling the worker to use the a variety of tools on his workbench in a secure and space saving manner.

SUMMARY OF THE INVENTION

In a first aspect the present invention provides an apparatus for use in removably securing a preselected tool to a workbench. The apparatus comprises a base plate member engageable with and permanently secured to such workbench, the base plate member having a substantially flat base portion. A first pair of radially opposed sides extend upwardly from the substantially flat base portion. A groove is disposed longitudinally along an outer surface of each of the first pair of radially opposed sides. There is a tool mounting plate member having a substantially flat top portion which has a second pair of radially opposed sides extending downwardly from the substantially flat top portion and a projection that is longitudinally disposed along an inner surface of each of the second pair of sides on the tool mounting plate member for interlocking engagement with a respective one of the grooves disposed on the first pair of radially opposed sides of the base plate member. There is also a means that is engageable with the base plate member and the tool mounting plate member for each of allowing such mounting plate member to be securely engaged with the base plate member during use of a tool and for allowing removal of such tool mounting plate member from the base plate member after such use of such tool.

OBJECTS OF THE INVENTION

It is, therefore, one of the primary objects of the present invention to provide a plate that is bolted directly to the workbench that offers the worker the ability to interchange tools.

Another object of the present invention to provide a plate that is bolted directly to a workbench that allows for more efficient use of the workspace.

Still another object of the present invention to provide a plate that is bolted directly to the workbench in which tools can easily be placed and removed from the plate.

Yet another object of the present invention to provide a plate that is bolted directly to the workbench in which all tools can be mounted in the same place each time.

Another object of the present invention is to provide a base plate and a tool mounting plate that are secured to each other by means of cam lock.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
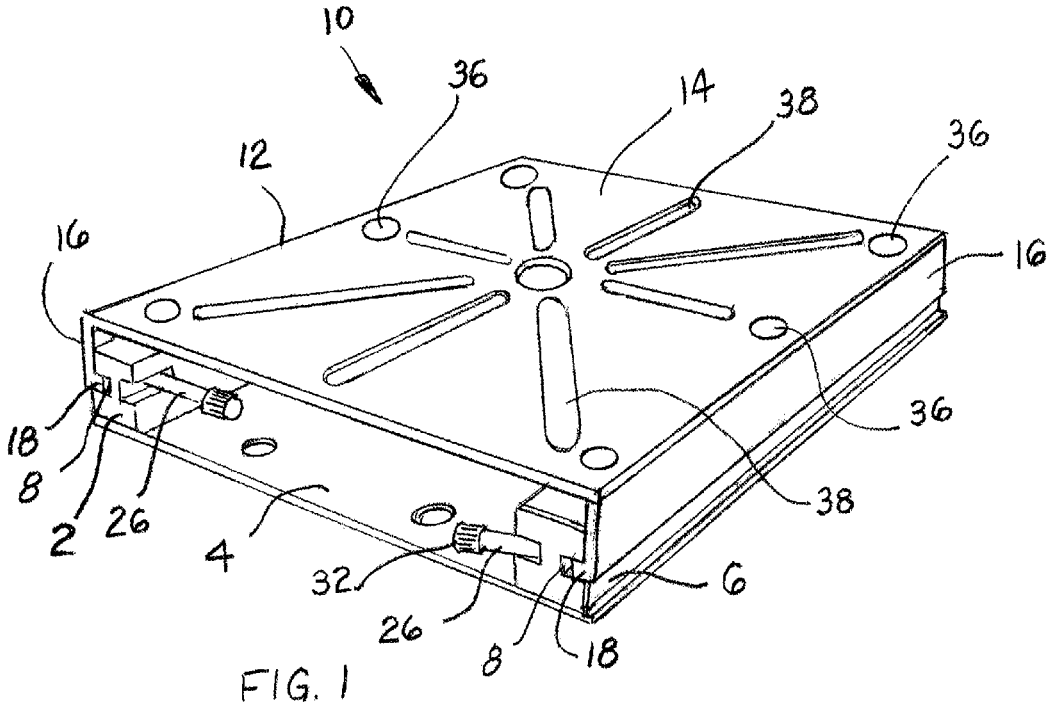
FIG. 1 is a perspective view of the apparatus according to an embodiment of the invention showing the two interlocking plates.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 3:
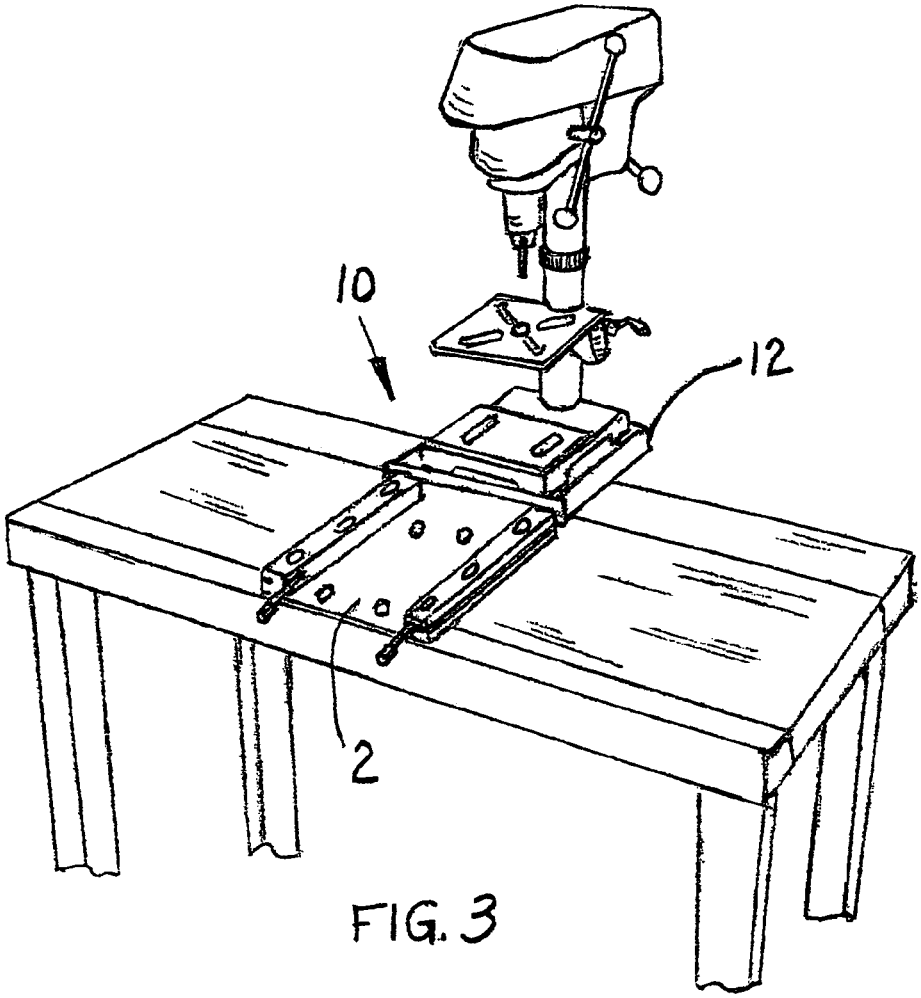
FIG. 3 is a perspective view of the apparatus showing a drill press attached to the workbench.
Figure 4:
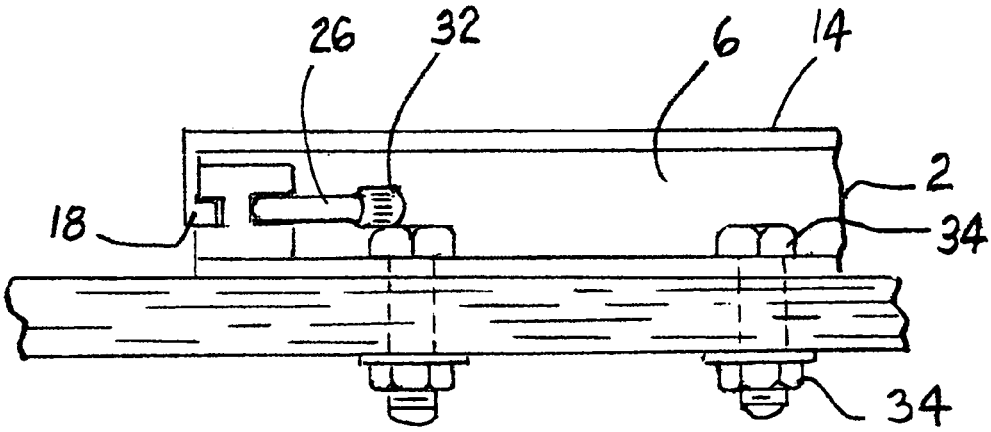
FIG. 4 is a perspective view of the apparatus showing the bolts attaching the flat base portion of the base plate to the workbench.
Figure 5:
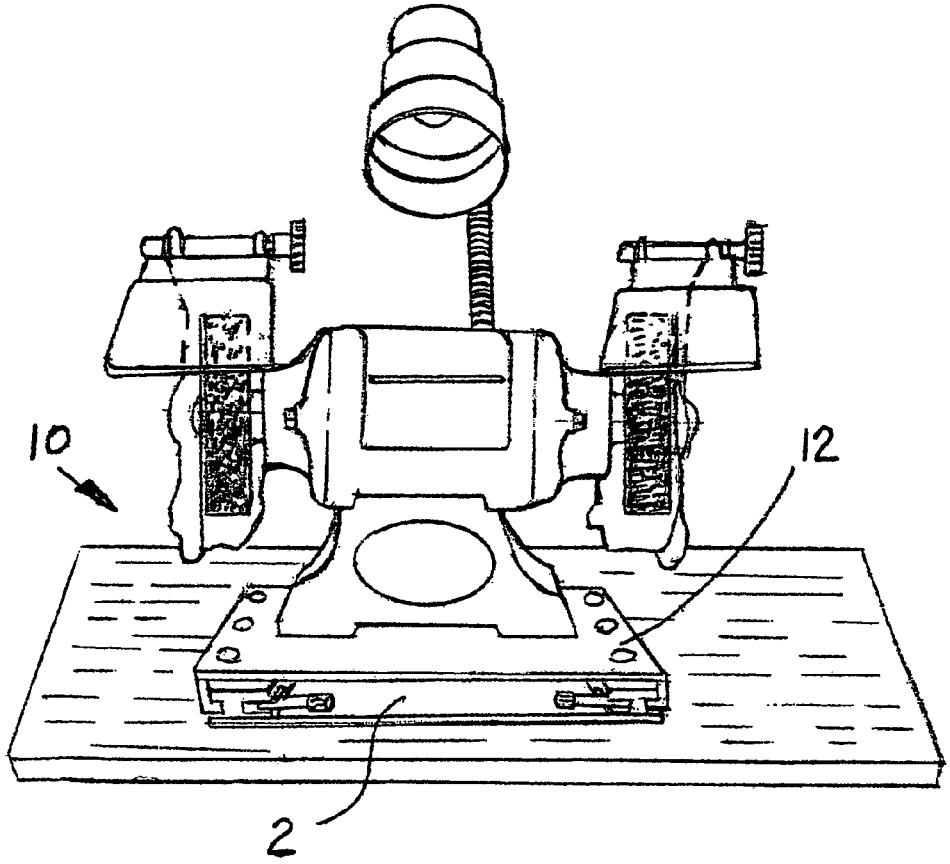
FIG. 5 is a perspective view of the apparatus showing a grinder attached to the workbench.

In a first aspect, as seen in FIGS. 1,3 and 5, the present invention provides an apparatus, generally designated 10, for use in removably securing a preselected tool to a workbench. The apparatus 10 comprises a base plate member 2 engageable with and permanently secured to such workbench, the base plate member 2 has a substantially flat base portion 4. A first pair of radially opposed sides 6 extend upwardly from the substantially flat base portion 4. A groove 8 is disposed longitudinally along an outer surface of each of the first pair of radially opposed sides 6. There is a tool mounting plate member 12 which has a substantially flat top portion 14 having a second pair of radially opposed sides 16 that extend downwardly from the substantially flat top portion 14 and a projection 18 that is longitudinally disposed along an inner surface of each of the second pair of sides 16 on the tool mounting plate member 12 for interlocking engagement with a respective one of the grooves 8 disposed on the first pair of radially opposed sides 6 of the base plate member 2. There is a means, generally designated 20, that is engageable with the base plate member 2 and the tool mounting plate member 12 for each of allowing the mounting plate member 12 to be securely engaged with the base plate member 2 during use of a tool and for allowing removal of such mounting plate member 12 from the base plate member 2 after such use of such tool.

Figure 2:
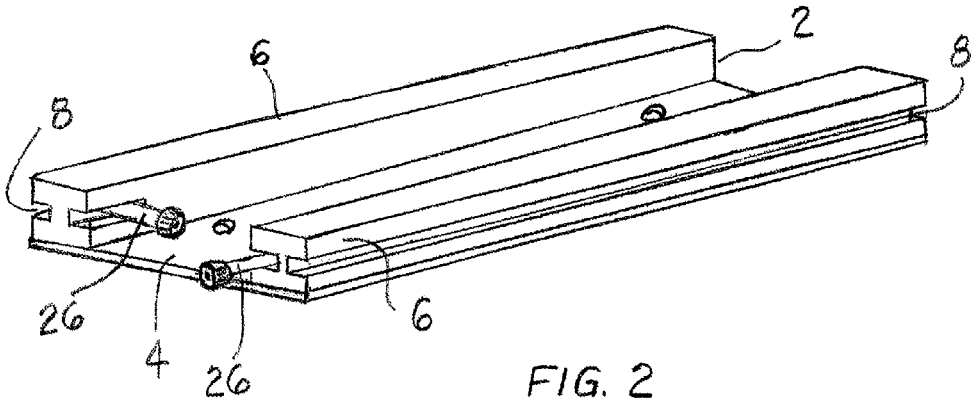
FIG. 2 is a is a perspective view of a portion of the base plate member of the apparatus shown in FIG. 1 showing elongated member of the cam lock.
Figure 7:
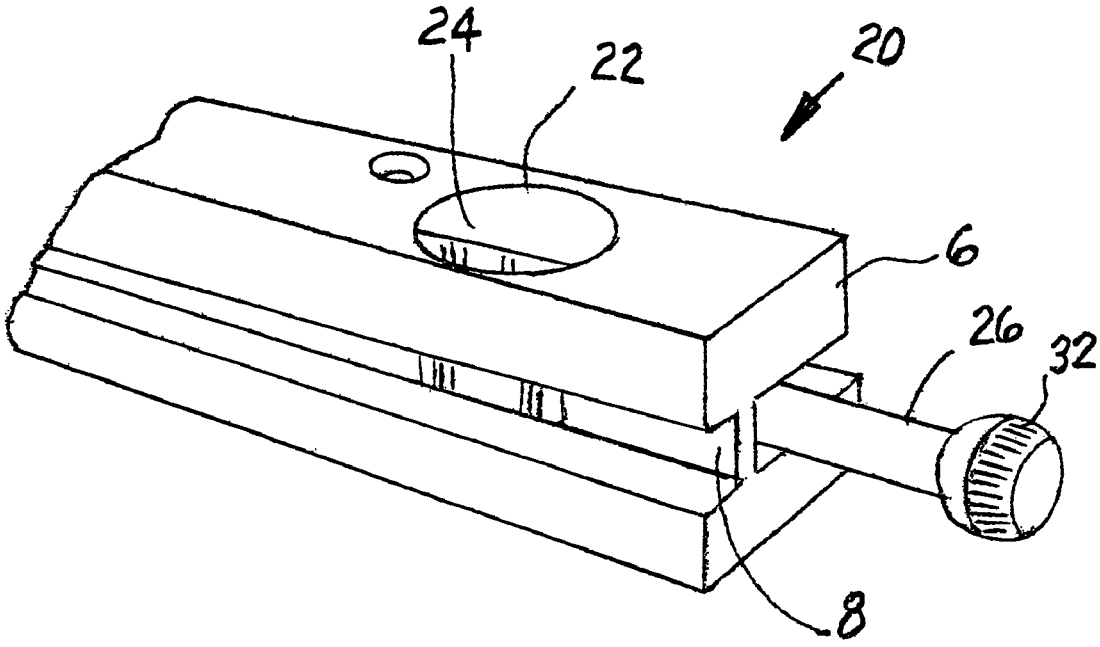
FIG. 7 is a perspective view of the cam lock member showing the cam lock member turned so that the flat portion of the truncated cylindrical member is positioned so as to permit the mounting plate member to slide out.
Figure 6:
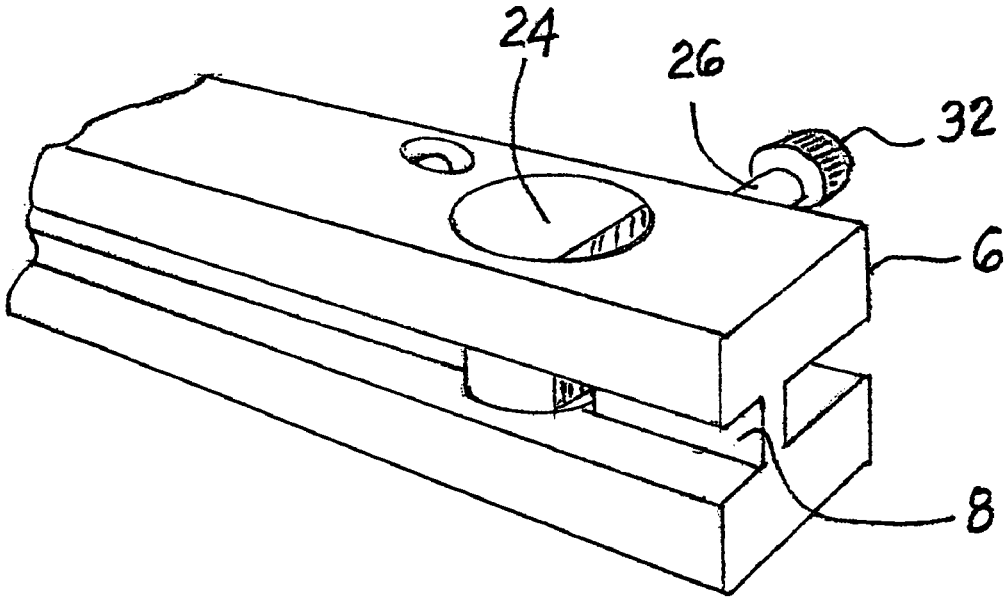
FIG. 6 is a perspective view of the cam lock member showing the cam lock member turned so that the arcuate portion of the truncated cylindrical member is positioned so as to engage the indentation in the mounting plate member.

The means 20, as is clearly seen in FIGS. 2, 6 and 7, includes a cam lock 22 pivotably disposed on the first pair of radially opposed sides 6 closely adjacent an end thereof. The cam lock 22 has a truncated cylindrical portion 24 disposed within each of the first pair of radially opposed sides 6 and an elongated portion 26 engageable with the truncated cylindrical portion 24. The elongated portion 26 is used for turning truncated cylindrical portion 26 from a locking position where the tool mounting plate member 12 is secured to the base plate 2 to a position where the tool mounting tool plate member 12 can be removed.

Figure 8:
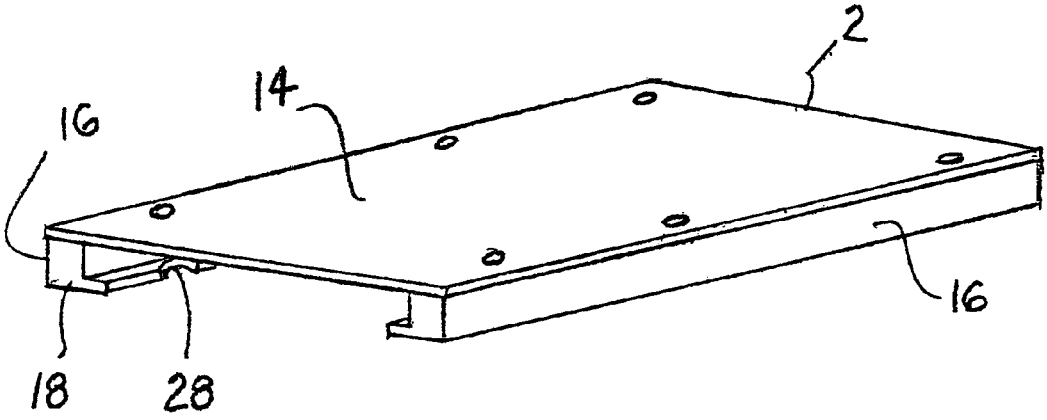
FIG. 8 is a perspective view of the tool mounting plate member showing the arcuate indentation on the inner surface of the projection.

As seen in FIG. 8 the means 20 further includes an arcuate indentation 28 disposed on an inner surface of each of the projections 18 closely adjacent an end thereof for receiving an arcuate portion of the truncated cylindrical portion 24 of the cam lock 22 so as to secure the mounting plate member 12 to the base plate member 2.

As seen in FIGS. 6 and 7, the truncated cylindrical portion 24 of the cam lock 22 engages the arcuate indentation 28 disposed on the inner surface of the projection 18 when the truncated cylindrical portion 24 is turned so that an arcuate portion of the truncated cylindrical portion 24 is in contact with the arcuate indentation 28 thus securing the tool mounting plate 12 to the base plate member 2.

When a flat portion of the truncated cylindrical member 24 is positioned so as to be opposite the arcuate indentation 28 that is disposed on the inner surface of the projection 18, then the mounting plate member 12 is free to slide in or out of the base plate member 2 since the flat portion does not contact the arcuate indentation 28.

It is also preferred that such elongated portion 26 of the cam lock 22 that is used for turning the cam lock 22 further includes a knob portion 32 disposed on an end of the elongated portion. The knob portion 32 is designed to make it easier for the user to turn the cam lock 22.

FIG. 1 shows the mounting plate 12 slid onto the base plate member 2. As can be seen the top of the mounting plate has a configuration showing a plurality of elongated slots in a predetermined arrangement along with a series of bolt holes. All of these are to designed to accommodate attaching a variety of tools to such tool mounting plate member 12. As stated previously there is one mounting plate 12 for each tool that is to be used. The mounting plate member 12 is attached to the base of the tool and it remains there. A plurality of apertures 36 are disposed on an upper surface of such tool mounting plate 12 closely adjacent outer edges thereof for ease of attaching such tool to the tool mounting plate 12. Also, there are a plurality of sloted members 38 disposed on such upper surface of tool mounting plate 12 for attaching such tool to the tool mounting plate 12. When the tool is to be used it is very simple to just attach the tool mounting plate 12 with the tool attached to the base plate member 2 and the user is ready to use that tool. When finished, or when another tool is needed, the cam lock 22 is turned thereby permitting the mounting plate member 12 with the tool attached to simply slide out of the base plate 2 and another tool with it's mounting plate member 12 attached is slid on to the base plate member 2, the mounting plate member 12 is secured in place with the cam lock 22 and the user is ready to use the other tool.

Further, it is presently preferred that such base plate member 2 is secured to such workbench by means of nuts and bolts 34.

Thus, the present invention provides an apparatus 10 that offers a simple method for using tools on a workbench without permanently mounting or positioning all of them at one time. The apparatus 10 consists of a two individual interlocking components.

There is a generally rectangular shaped metal mounting plate 12 that measures approximately 11 inches long by 1¼ inches high by 10 inches wide, milled on the top, which allows for easy mounting of most bench top tools to a table top base plate member 2 which is attached to a work bench. When the two plates are mounted together the unit is approximately 1½ in height. The tool mounting plate 12 is attached, one per tool, to the bottom of the tool in a predetermined manner enabling the user to change tools when needed without losing time interchanging the tool mounting plate 12. The tool mounting plate 12 is designed with overhanging side edges that interlock with the sides of the base plate member 2 onto which it will slide. The tabletop base plate member 2 is designed so that the protruding outer edges permit the tool mounting plate member 12 to slide onto and into the base plate member 2 for secure positioning of the two plates together. The base plate member 2 can be bolted to the worktable or affixed in another predetermined manner. A cam lock member 22 is used to securely hold the mounting plate member 12 to the base plate member 2 until readied for removal.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for use in removably securing a preselected tool to a workbench, said apparatus comprising:

(a) a base plate member engageable with and permanently secured to said workbench, said base plate member having a substantially flat base portion;

(b) a first pair of radially opposed sides extending upwardly from said substantially flat base portion;

(c) a groove disposed longitudinally along an outer surface of each of said first pair of radially opposed sides;

(d) a tool mounting plate member having a substantially flat top portion;

(e) a second pair of radially opposed sides extending downwardly from said substantially flat top portion;

(f) a projection longitudinally disposed along an inner surface of each of said second pair of sides on said tool mounting plate member for interlocking engagement with a respective one of said grooves disposed on said first pair of radially opposed sides of said base plate member; and (g) means for each of allowing said tool mounting plate member to be securely engaged with said base plate member during use of a tool and for allowing removal of said tool mounting plate member from said base plate member after such use of such tool is engageable with said base plate member and said tool mounting plate member, said means includes a cam lock pivotably disposed on said first pair of radially opposed sides closely adjacent an end thereof.

2. The apparatus, according to claim 1, wherein said cam lock has a rotatable truncated cylindrical portion disposed within said first pair of radially opposed sides and an elongated portion engageable with said rotatable truncated cylindrical portion, said elongated portion used for turning said rotatable truncated cylindrical portion.

3. The apparatus, according to claim 2, wherein said means further includes an arcuate indentation disposed on an inner surface of said projection closely adjacent an end thereof for receiving a portion of said truncated cylindrical portion of said cam lock so as to secure said tool mounting plate member to said base plate member.

4. The apparatus, according to claim 3, wherein said rotatable truncated cylindrical portion of said cam lock engages said arcuate indentation disposed on said inner surface of said projection when said rotatable truncated cylindrical portion is turned so that an arcuate portion of said rotatable truncated cylindrical portion is in contact with said arcuate indentation thus securing said tool mounting plate to said base plate member and wherein said tool mounting plate member is free to slide in and out of said base plate member when a flat portion of said rotatable truncated cylindrical member is positioned so as to be opposite said arcuate indentation disposed on said inner surface of said projection.

5. The apparatus, according to claim 1, wherein said base plate member is secured to such workbench by nuts and bolts.

6. The apparatus, according to claim 2, wherein said elongated portion used for turning said truncated cylindrical portion further includes a knob portion disposed on an end of said elongated portion.

7. The apparatus, according to claim 1, wherein there is one separate said tool mounting plate member for each tool to be used.

8. The apparatus, according to claim 1, wherein said tool mounting plate member is attached to a bottom portion of a tool.

9. The apparatus, according to claim 1, wherein said substantially top flat portion of said tool mounting plate member includes a plurality of elongated slotted members disposed in a predetermined arrangement for attaching said tool mounting plate member to a tool.

10. The apparatus, according to claim 1, wherein said substantially flat top portion of said tool mounting plate member further includes a plurality of apertures disposed closely adjacent outer edges thereof for ease in attaching a tool to said tool mounting plate member.

* * * * *